US006236828B1

(12) United States Patent
Munenaka et al.

(10) Patent No.: US 6,236,828 B1
(45) Date of Patent: May 22, 2001

(54) IMAGE FORMING APPARATUS

(75) Inventors: Katsumi Munenaka, Kawasaki; Kiyoshi Oyama, Tokyo, both of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/388,430

(22) Filed: Sep. 2, 1999

(30) Foreign Application Priority Data

Sep. 2, 1998 (JP) ..... 10-264048
Aug. 17, 1999 (JP) ..... 11-230475

(51) Int. Cl.[7] ..... G03G 15/00; G03G 15/16
(52) U.S. Cl. ..... 399/303; 399/299
(58) Field of Search ..... 399/299, 303, 399/312, 315, 388, 390

(56) References Cited

U.S. PATENT DOCUMENTS 5,502,545 * 3/1996 Tsuruoka ..... 399/21
5,537,193 7/1996 Hasegawa et al. ..... 399/398
5,771,434 * 6/1998 Hokari ..... 399/303 X
5,784,674 * 7/1998 Iseki et al. ..... 399/299 X
5,802,422 * 9/1998 Hokari ..... 399/36
5,842,095 * 11/1998 Kitamura ..... 399/299

FOREIGN PATENT DOCUMENTS 2-013976 1/1990 (JP) .

* cited by examiner

*Primary Examiner*—Sophia S. Chen
(74) *Attorney, Agent, or Firm*—Fitzpatrick, Cella, Harper & Scinto

(57) ABSTRACT

An image forming apparatus includes a transfer material carrying belt for carrying a transfer material; a support for supporting the transfer material carrying belt at a side opposite from a side carrying the transfer material; an image forming unit for forming an image on a transfer material carried on the transfer material carrying belt; wherein the support is disposed at a position out of a portion where the carrying belt constitutes a carrying surface for the transfer material, and includes a driving roller for driving the transfer material carrying belt and a follower roller which is disposed at a position where the transfer material is separated from the transfer material carrying belt after completion of image formation of the image forming unit.

36 Claims, 4 Drawing Sheets

IMAGE FORMING APPARATUS

FIELD OF THE INVENTION AND RELATED ART

The present invention relates to an image forming apparatus, for example, a copying machine, a printer, a facsimile machine, or the like. In particular, it relates to an image forming apparatus which forms an image on a piece of transfer medium borne on a belt for conveying the transfer medium.

Generally, an image forming apparatus which employs an electrophotographic process comprises an image forming stations, a conveying means, and a fixing means. In the image forming station, a latent image is formed with the use of light, magnetism, and electrical charge, and the latent image is developed into a visible image. The conveying means conveys the transfer medium to the image forming station so that the visible image formed in the image forming station is transferred onto the transfer medium. The fixing means fixes the visible image onto the transfer medium after the image is transferred to the transfer medium.

The image forming station comprises a medium, for example, an electrophotographic photosensitive member, on which an image is formed. Such a medium varies in characteristics, for example, shape. The image forming station comprises a means for forming a latent image, and a means for developing a latent image. These means also vary in characteristics so that they match with an image forming means.

A substantial number of image forming apparatuses, in particular, full-color image forming apparatuses, employ an electrostatic conveying means, that is, a conveying means which uses electrostatic force to hold a transfer medium on its surface while conveying the transfer medium from the transfer means to the fixing means. This is due to the fact that an electrostatic conveying means is superior to other conveying means in many respects. A color image forming apparatus is an apparatus which forms a full-color image by laying in layers multiple images on a transfer medium with the use of multiple image forming stations.

One of the well known patent documents which disclose image forming apparatuses which employ the above described system or the like is Japanese Patent Laid-Open Application No. 13,976/1990. FIG. 7 depicts, in general structure, one of the image forming apparatuses disclosed in that document.

The image forming apparatus in FIG. 7 comprises three image forming stations: I, II, and III, a conveying means 139, and a fixing means 56. The conveying means 139 has a conveyer belt 126 for conveying transfer medium, and extends below the three image forming stations I, II, and III. The fixing means is equipped with thermal rollers 56*a* and 57*b* for fixing the images on the transfer medium to the transfer medium, and is disposed at the exit portion of the conveying means 139. The image forming stations I, II, and III are equipped with photosensitive drums 111, 112, and 113, charging devices 114, 115, and 116, developing devices 117, 118, and 119, charging devices 120, 121, and 122 for image transfer, and cleaners 123, 124, and 125, correspondingly.

The conveyer belt 126 is formed of resin. In an image forming operation, its surface is electrically charged by a charging device 133 for adhesion, to adhere a transfer medium to the surface of the conveyer belt 126, and charge it so that the transfer medium is reliably conveyed.

The conveyer belt 126 is supported by a driver roller 131 and a follower roller 134, and is stretched between them with the application of a predetermined amount of tension. As the driver roller 131 is rotationally driven, the transfer belt 126 moves at a predetermined velocity.

After being released into the apparatus by a registration roller 49, a transfer medium is pinched by the follower roller 134 of the transfer medium conveying means 139, and a pressing roller 52 pressed upon the follower roller 134 through the conveyer belt 126, and while the transfer medium 46 is passed between the two rollers, it is pressed upon the electrically charged conveyer belt 126, so that the transfer medium 46 is electrostatically adhered to the conveyer belt 126 in a desirable manner, that is, without becoming wavy.

The rotational velocity of the registration roller 49 is set to be slightly higher than the velocity, or conveying velocity, of the conveyer belt 126, to cause the transfer medium 46 to elastically bend slightly so that the transfer medium 46 is not affected by the rotational velocity of the registration roller 49.

Under a high humidity-high temperature environment, the conveyer belt 126 is not sufficiently charged, which sometimes allows portions or the entirety of the transfer medium to behave as if "floating" on the surface of the transfer medium. If the floating of the transfer medium occurs, transfer failures may occur. For example, a portion or portions of an image may become misaligned, or the entirety of an image may become misaligned relative to the transfer medium. Further, a portion or portions of an image may drop out. In order to prevent such problems, an auxiliary roller 200 and an idler roller 203 are provided, which are enabled to freely rotate while pinching the conveyer belt 126.

With the provision of the auxiliary roller 200 described above, the transfer medium is prevented from floating from the conveyer belt 126 when an image formed in the image forming station is transferred onto the transfer medium which is being moved forward by the conveyer belt 126. In other words, it is assured that the transfer medium remains adhered to the conveyer belt 126. Therefore, an excellent image, that is, an image which does not suffer from the above described partial misalignment, registration failure, or partial image drop-out, can be formed.

On the other hand, if the conveyer belt 126 meanders or deviates while running, an image transferred onto the transfer medium in one of the image forming stations may not align with an image from another image forming station (hereinafter, "registration misalignment"). In order to prevent this problem, an image forming apparatus is usually provided with one of several means for correcting the meandering or deviating. For example, an image forming apparatus may be provided with guiding ribs, which may be arranged along one edge, or both edges, of the conveyer belt 126, along the entire length of the belt, or some of the aforementioned rollers which support and/or stretch the conveyer roller 126 may be provided with guiding grooves. Further, the rollers may be provided with "shoulder ribs" for guiding the conveyer belt 126.

However, in the case of the above described conventional means for preventing the meandering or deviating of the conveyer belt, the driver roller 131 is positioned at the most downstream end, in terms of the transfer medium movement, of the range in which the conveyer belt conveys the transfer medium. Therefore, there are the following problems.

That is, one of the methods for making it difficult for the conveyer belt 126 to slip on the driver roller 131 is to increase the diameter of the driver roller 131 (standard method is to increase it to 20 mm or larger). However, if increasing the driver roller diameter becomes the priority, a problem occurs. More specifically, the larger the diameter of the driver roller 131, the smaller the curvature of the conveyer belt 126 at the predetermined point at which the transfer medium 46 becomes separated from the conveyer belt 126 to be delivered to a fixing means 56, and the smaller the curvature of the conveyer belt 126 at the separation point, the more difficult it is for the transfer medium 46 to be separated from the conveyer belt 126 by the curvature of the conveyer belt 126 and the resiliency of the transfer medium 46. Thus, if the transfer medium 46 is weak in resiliency, or temperature and/or humidity are very high, the transfer medium 46 is liable to fail to separate from the conveyer belt 126, and jam the apparatus.

On the contrary, if the driver roller diameter is decreased to prioritize the transfer medium separation from the conveyer belt 126 at the predetermined separation point (standard method is to reduce the diameter to 20 mm or less), the size of the contact area between the driver roller 131 and the conveyer belt 126 decreases, increasing the possibility that slipping occurs between the conveyer belt 126 and the driver roller 131. Thus, it is not assured that the transfer medium 46 is reliably conveyed.

There are two commonly used methods for preventing slipping from occurring between the driver roller 131 and the conveyer belt 126: a method in which the coefficient of friction across the contact surface, or interface, between the conveyer belt 126 and driver roller 131 is kept above a predetermined level, and a method in which the tension of the conveyer belt 126 is increased to increase the contact pressure across the interface. However, it is possible that these methods cause the creep of the conveyer belt 126 to deteriorate, or cause the conveyer belt 126 to fatigue, as the belt is repeatedly bent and/or stretched as it goes around the driver roller 131 and the follower roller 134. Therefore, the tension of the conveyer roller 126 must not be limitlessly increased.

Further, the driver roller 131 is disposed adjacent to a thermal fixing means 56, being therefore liable to be affected by the heat from the pair of heat rollers 56*a* and 56*b* of the thermal fixing means 56. In other words, there is a possibility that the temperature of the driver roller 131 substantially increases while the apparatus is in operation. As the driver roller 131 increases in temperature, it increases in diameter, which in turn increases the velocity of the conveyer belt 126. As a result, an image may be stretched or shrunk. This problem is of grave concern in the case of a color image forming apparatus in which a full-color image is formed by laying in layers multiple toner images, because the fluctuation in the conveying speed of the conveyer belt 126 exactly manifests as color deviation in the final image, or the full-color image, which is a large problem in terms of image quality.

In order to provide a large enough coefficient of friction between the driver belt 131 and the conveyer belt 126, it is necessary to provide the surface of the driver roller 131 with a layer of material, such as rubber, which has a large coefficient of friction. Whereas, material high in frictional coefficient such as rubber is greater in thermal expansion by approximately an order of magnitude than the material (usually, metallic material such as iron, aluminum, and the like) for the core of the driver roller 131, and the heat expansion caused by temperature increase has grave effects upon the performance of the conveying means.

In recent years, it has become increasingly necessary to reduce the size of an image forming apparatus, even in a full-color image forming apparatus. However, if a plural number of image forming stations are aligned in a series in an image forming apparatus as in the above described color image forming apparatus, the distance the transfer medium is conveyed becomes long. As a result, the main assembly of an image forming apparatus must be increased in dimension, in particular, in terms of the direction in which the transfer medium is conveyed.

For the purpose of reducing the size of the main assembly of an image forming apparatus, it is effective to reduce as much as possible the distance between the transfer conveying means 139 and fixing apparatus 56, and the distance between the transfer conveying means 139 and the registration roller 49.

However, in the case of the above described conventional apparatus, it is necessary to provide a certain amount of distance between the driver roller 131 and the fixing apparatus 56 in order to avoid the occurrence of color deviation for which the heat from the fixing apparatus 56 is responsible as described above.

There have been various methods for preventing the driver roller from being affected by the heat from the fixing apparatus 56. According to one of the methods, the driver roller is disposed at a point 134 in FIG. 7, that is, the upstream end, in terms of the transfer medium conveyance direction, of the range in which the transfer medium is conveyed by the conveyer roller.

However, in the case of a conventional image forming apparatus such as the one described above, the diameter of the driver roller (134) must be greater than a certain range, in order for the driver roller (134) not to slip. This means that the distance between the registration roller 49 and the driver roller (134) exceeds a certain range.

There must be disposed unillustrated driving mechanisms for the registration roller 49 and driver roller 134 behind or in front of them, respectively. Therefore, the rollers must be arranged to provide a space large enough for the two driving mechanisms, which means more distance between the registration roller 49 and the driver roller (134).

In other words, in the case of the above described conventional structure for a transfer medium conveying means, whether the driver roller is disposed on the most downstream end (131) or most upstream end (134), in terms of the transfer medium conveyance direction, of the range in which the transfer medium is conveyed by the conveyer belt, the size of the apparatus main assembly must be greater in width in terms of the transfer medium conveyance direction than a certain range.

SUMMARY OF THE INVENTION

The primary object of the present invention is to provide an image forming apparatus in which a transfer medium is reliably conveyed by the conveying means, and reliably separates from the conveying means.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Hereinafter, an image forming apparatus in accordance with the present invention will be described in detail with reference to the appended drawings.

Figure 1:
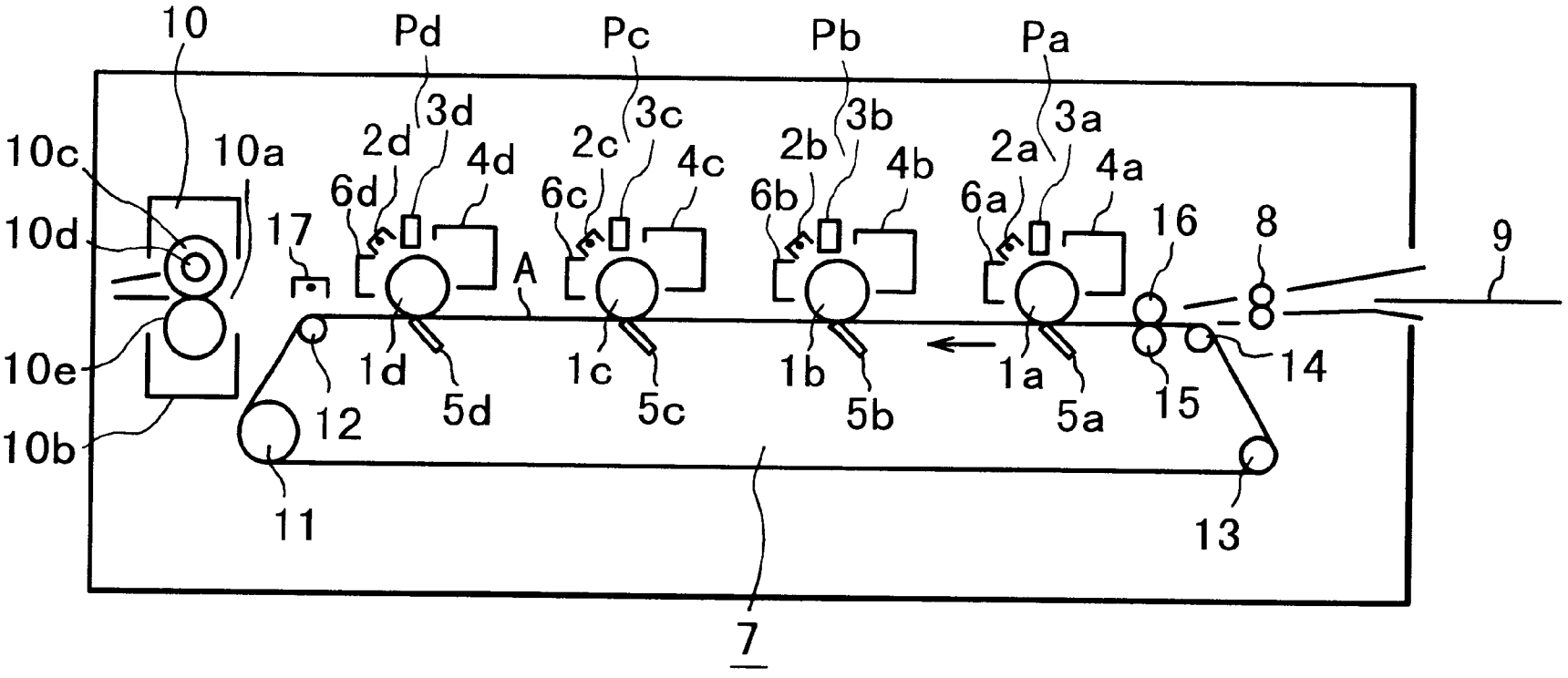
FIG. 1 is a schematic vertical sectional view of an example of an image forming apparatus in accordance with the present invention, as seen from the front side of the apparatus.

Referring to FIG. 1, the electrophotographic color image forming apparatus as an example of an image forming apparatus in accordance with the present invention comprises four stations Pa, Pb, Pc, and Pd for forming images, in which photosensitive drums 1*a*, 1*b*, 1*c*, and 1*d* as a rotational image bearing member are correspondingly disposed. Each photosensitive drum is dedicated to a specific color. Along the peripheral surface of each photosensitive drum (1*a*, 1*b*, 1*c*, and 1*d*), a charging device for primary charge (2*a*, 2*b*, 2*c*, and 2*d*), an exposing means (3*a*, 3*b*, 3*c*, and 3*d*), a developing device (4*a*, 4*b*, 4*c*, and 4*d*), a charging device for transfer (5*a*, 5*b*, 5*c*, and 5*d*), a cleaning means (6*a*, 6*b*, 6*c*, and 6*d*) are disposed in this order in terms of the rotational direction of the photosensitive drum.

The image forming apparatus also comprises a conveying apparatus 7 which employs an endless belt. The belt based conveying apparatus 7 is below the four image forming stations, which are aligned in a straight line. Its endless belt horizontally runs along the bottom side of the photosensitive drum of each image forming station. It conveys a transfer medium 9. More specifically, as the transfer medium 9 is fed into the image forming apparatus by a pair of registration rollers 8 disposed at one end of the conveying apparatus 7, the conveying apparatus 7 conveys the transfer medium 9 between the charging device for image transfer (5*a*–5*b*) and the image forming station (Pa–Pd).

In this type of an electrophotographic color image forming apparatus, a full-color image is formed in the following manner.

First, a latent image correspondent to the yellow component of the image on an original copy is formed on the photosensitive drum 1*a* by the charging device 2*a* for primary charge and exposing means 3*a* in the first image forming station Pa, based on a known electrophotographic process. Next, this latent image is developed into a visible image (yellow image) by the developing device 3*a* which contains the developer (toner) with yellow color. Then, this visible image, an image composed of yellow toner, is transferred by the charging device 4*a* for image transfer, onto the transfer medium 9 delivered by the belt based conveying apparatus 7.

While this yellow toner image is transferred onto the transfer medium 9, a latent image correspondent to the magenta component of the image on the original copy is formed on the photosensitive drum 1*b* in the same manner as the latent image for the yellow component was formed. Then, the magenta toner image is composed of the magenta toner in the developing station 4*b*. Then, as the transfer medium 9, onto which the yellow toner image has been completely transferred in the first image forming station Pa, is delivered to the charging device 5*b* for image transfer in the image forming station Pb, the magenta toner image is transferred onto a predetermined portion of the transfer medium 9 with the yellow toner image.

Then, the same image formation process as the one described above is carried out also for cyan and black colors. As a result, four toner images of different color are placed in layers on the transfer medium 9. Next, the transfer medium 9 is conveyed to the fixing station 10 located at the downstream end of the belt based conveying apparatus 7. In the fixing station 10, the four images are fixed to the transfer medium 9 to yield a permanent multicolor (full-color) copy of the original image.

Meanwhile, the toner which is remaining on the photosensitive drum (1*a*–1*d*) after the image transfer is removed by the cleaning means (6*a*–6*d*) to prepared the photosensitive drum for the following step in which a latent image is formed.

The image forming apparatus in this embodiment is configured so that the distance in the transfer medium conveyance direction between the registration roller pair 8 and the point (adhesion point, or locations of roller 15 or 16) at which the transfer medium begins to be adhered to the conveyer belt, becomes shorter than the length of a transfer medium of the smallest size, for example a post card (100 mm×148 mm), usable in the apparatus, in terms of the transfer medium conveyance direction. Also, the distance in the transfer medium conveyance direction between the point (separation point) at which a transfer medium separates form the conveyer belt 100, and the fixing nip which the fixing rollers 10*c* and 10*e* form is shorter than the length of a transfer medium of the smallest size usable in the apparatus, in terms of the transfer medium conveyance direction. With this structure, there is no need for placing any kind of apparatus for relaying the transfer medium across the aforementioned distances, in the intervals between the aforementioned registration roller pair 8 and the adhesion point, and between the separation point to the fixing portion. Therefore, it becomes possible to reduce the image forming apparatus size.

Next, referring to FIGS. 1 and 2, a belt based conveying apparatus 7 which is employed in the above described color image forming apparatus will be described.

Figure 2:
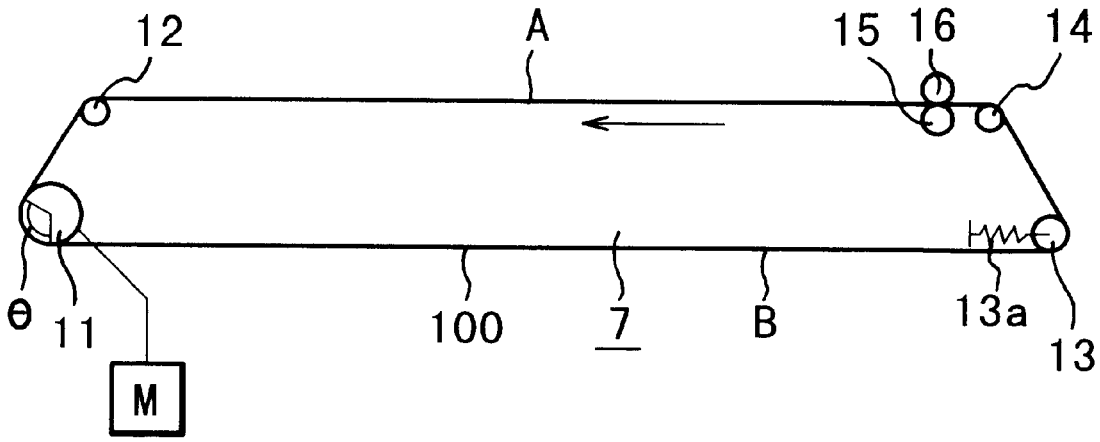
FIG. 2 is a schematic vertical sectional view of the belt based conveying apparatus in the first embodiment of the present invention.

Referring to FIG. 2, the conveyer belt 100 of a conveying apparatus 7 is stretched around a driver roller 11, and three follower rollers 12, 13, and 14 (first, second, and third follower rollers, correspondingly). As the driver roller 11 is rotated by a motor M, the conveyer belt 100 runs in the direction indicated by an arrow mark in the drawing.

The positions of the first follower roller 12 and the driver roller 11 relative to the conveying apparatus 7 are fixed.

The second follower roller 13 gives the conveyer belt 100 tension with the help of an elastic member 13*a* (spring or the like). In other words, it doubles as a tension roller.

The third follower roller 14 is configured to that the angle of the axial line of the follower roller 14 relative to the axial line of the driver roller 11 can be adjusted within a range in which the transfer process is successfully carried out. In other words, this roller doubles as an alignment roller. More specifically, the deviation of the conveyer belt 100 in the primary scan direction (direction perpendicular to transfer medium conveyance direction) can be controlled by adjusting the alignment of this third follower roller 14 relative to the driver roller 11, so that the conveyer belt 100 remains substantially centered, that is, without deviating too far in the primary scan direction.

Referring to FIG. 2, the belt based conveying apparatus 7 in this embodiment comprises another follower roller, the fourth follower roller 15 to which voltage with a predetermined level is applied to electrostatically adhere the transfer medium to the conveyer belt 100. This roller is located adjacent to the third follower roller 14, and is paired with a pressing roller 16, which opposes the fourth follower roller 15 through the conveyer belt 100, and generates an overall compressive force of approximately 25 N.

Since the primary function of the pressing roller 16 is to press a transfer medium onto the conveyer belt 100 so that the transfer medium is better adhered to the conveyer belt 100, the magnitude of the coefficient of friction of the peripheral surface of the pressing roller 16 is irrelevant. Therefore, there is no restriction regarding the material for the pressing roller 16.

A range A in which the conveyer belt 100 bears a transfer medium on its outwardly facing surface is the range between the first and third follower rollers 12 and 14 of the conveying apparatus 7. Moreover, the first follower roller 12 doubles as a separation roller which gives the conveyer belt 100 a curvature large enough to cause a transfer medium to separate from the conveyer belt 100 (separation based on curvature difference).

The driver roller 11 is disposed on the downstream side of the first follower roller 12 in terms of the running direction of the conveyer belt 100, more specifically, the downstream end of the conveyer belt 100 and below the plane of the top portion (portion in range A) of the conveyer belt loop. Further, the fixing nip is on the top side of the top portion of the loop, that is, on the photosensitive drum side. In other words, the driver roller 11 is disposed at a level below the fixing apparatus 10, substantially away from the opening 10*a*, a slit, of the fixing apparatus 10, as shown in FIG. 1. The temperature of the bottom portion of the fixing apparatus 10 remains relatively low due to the convection by natural air current (or forced air current created by an unillustrated fan or the like) adjacent to the fixing apparatus 10. Therefore, the temperature of the bottom casing 10*b* increases very little. Consequently, the amount of the thermal energy which the driver roller 11 receives from the bottom casing 10*b* of the fixing apparatus 7 is very small. Further, as the temperature of the heater 10*d* contained in the heating roller 10*c* of the fixing apparatus 7 is increased for image fixation, a substantial amount of radiant heat is generated from the heater 10*d*, and radiates from the peripheral surface, or heat applying surface, of the elastic layer which covers the heater 10*d*. However, this radiant heat does not directly reach the driver roller 11, which also helps minimize the increase in the temperature of the driver roller 11. Thus, the configuration of the belt based conveying apparatus 7, in accordance with the present invention can keep at the minimum level the fluctuation in the velocity of the conveyor belt 100, so that color deviation can be kept at the minimum level. In other words, high quality images can be produced.

The driver roller 11 comprises a metallic core formed of iron, aluminum, or the like, and a layer of elastic material, such as rubber or urethane, coated on the peripheral surface of the metallic core.

The external diameter (30.5 mm) of the driver roller 11 is approximately twice as large as the external diameter (15 mm) of the first follower roller 12. This arrangement provides a larger contact area between the driver roller 11 and conveyor belt 100, helping to keep at the minimum level the fluctuation in the velocity of the conveyer belt 100 caused by the slipping which occurs between the driver roller 11 and the conveyer belt 100. Further, in this embodiment, the first follower roller 12, or the separation roller, is smaller in the external diameter, and therefore, it is greater in the curvature of its peripheral surface. Evidently, the greater the curvature of the peripheral surface of the separation roller, the greater the difference in curvature between the conveyer belt 100 and the transfer medium, which causes the transfer medium to separate from the conveyer belt 100. Therefore, the conveyer apparatus structure in this embodiment more efficiently separates a transfer medium from the conveyer belt 100 than the conventional one, assuring that even a transfer medium weak in resiliency cleanly separates from the conveyer belt 100. In other words, the present invention makes it possible to provide an image forming apparatus which does not suffer from paper jams.

Further, the conveyer belt 100 is wrapped around the driver roller 11 in such a manner that the contact angle θ of the conveyer belt 100 and the driver roller 11, that is, the angle between the two lines formed by connecting the center of the driver roller 11 with one end of the contact area between the conveyer belt 100 and the driver roller 11 and the other end, is approximately 120° (θ=120°), being greater than 90° (FIG. 2). This arrangement reduces the fluctuation in the velocity of the conveyer belt 100 which is caused by the slipping between the conveyer belt 100 and the driver roller 11. Therefore, even after the coefficient of the surface friction of the driver roller 11 reduces due to continuous extended usage, the slipping does not occur, and therefore, the conveyer belt 100 conveys a transfer medium at a constant velocity, making it possible to form high quality images.

Further, since the first follower roller 12, the separation roller, is smaller in diameter than the driver roller 11, and is formed of electrically conductive metallic material, it is unnecessary to coat the peripheral surface of the first follower roller 12 with rubber or the like. Therefore, there is no concern that the first follower roller 12, or the separation roller, is electrically affected by the corona effected by Corotron to facilitate the separation. Thus, the first follower effectively functions as a counter electrode.

Further, Corotron 17 is disposed directly above the first follower roller 12 to increase the amount of ions in the limited ambience immediately adjacent to the point at which a transfer medium separates from the conveyer belt 100. This setup prevents the electrical discharge from occurring between a transfer medium and the conveyer belt 100 and/or between a transfer medium and the first follower roller 12. Therefore, it is possible to produce high quality images (images with no anomaly).

Itemized below are the effects peculiar to this embodiment of the present invention.

Referring to FIG. 2, a referential character A designates the portion of the peripheral surface of the conveyer belt, which is running through the top portion of the conveyer belt loop, and a referential character B designates the portion of the conveyer belt, which opposes the portion A from below. The relationship between the tensional forces which work on the portions A and B when the force applied to the tension roller 13 is F, and the conveyer belt 100 is running in the direction indicated by the arrow mark in the drawing is: Ta>Tb. The magnitude of the Ta and Tb are determined by the magnitude of F.

If the flatness of a transfer medium is disturbed by the shock or the like which occurs at the time of the transfer medium adhesion, color deviation or the like occurs, which results in images of poor quality. Therefore, the portion A must be kept virtually flat. In order to keep the portion A virtually flat, the magnitude of the tension applied to the portion A must be higher than a certain level.

In the case of a conventional transfer medium conveying apparatus, the driver roller is disposed on the upstream end of the aforementioned portion A in terms of the transfer medium conveyance direction, for the purpose of minimizing the effect of the heat from the fixing apparatus upon the driver roller, and also for defining the upstream end of the above defined portion A. In this case, the relationship between the tensional forces Ta' and Tb', which work on the aforementioned portions A and B, respectively, when the conveyer belt is running in the direction indicated by the arrow in the drawing is: Ta'<Tb' and the magnitude of the Ta' and Tb' are determined by the magnitude of the force F' applied to the tension roller.

In order to keep the portion A as flat as the conveyer apparatus structure in accordance with the present invention does, Ta' must be equal to Ta (Ta'=Ta). As stated before, Ta>Tb. Therefore, Tb'>Ta'=Ta>Tb. Thus, in order to satisfy this formula, the force to be applied to the tension roller in the conventional structure must be larger than the force applied to the tension roller in the structure in accordance with the present invention: F'>F. In other words, if a transfer medium conveying means is structured as a conventional transfer medium conveying means in which the driver roller is disposed on the upstream end of the aforementioned portion A in terms of the transfer medium conveyance direction, and in which the driver roller defines the upstream end of the portion A, the force applied to the tension roller must be greater than that in the transfer medium conveying apparatus in accordance with the present invention in which the driver roller is disposed on the downstream end of the above defined portion A, and does not define the downstream end of the portion A. As described above, the greater the force applied to the tension roller, the worse the creep and fatigue of the conveyor belt, and therefore, the shorter the service life of the conveyer belt, and therefore, the higher the running cost for the main assembly of an image forming apparatus.

In other words, according to this embodiment of the present invention, the driver roller 11 can be placed on the downstream end of the conveyer belt in terms of the transfer medium conveyance direction without causing grave side effects, and the above defined portion A can be sufficiently tensioned by a force much smaller than the force required for the conventional transfer medium conveying apparatus. Therefore, the conveyer belt 100 lasts longer. Thus, it is possible to provide an image forming apparatus inexpensive in running cost.

Figure 3:
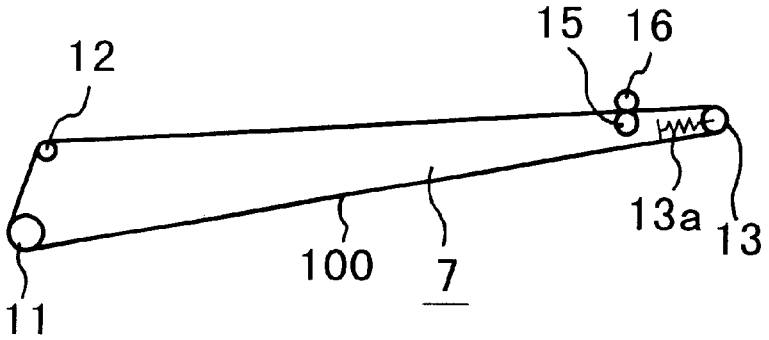
FIG. 3 is a schematic vertical sectional view of the belt based conveying apparatus in the modification of the first embodiment of the present invention.

Also according to this embodiment, four rollers are employed to suspend the conveyer belt 100. However, the number of rollers may be three as depicted in FIG. 3, which is self-explanatory.

Embodiment 2

Figure 4:
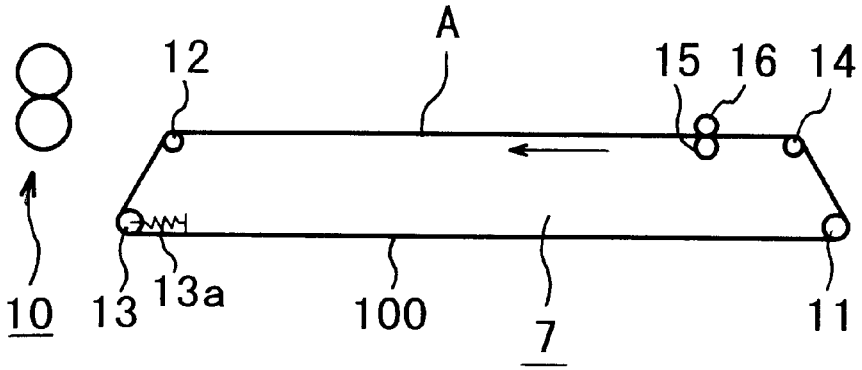
FIG. 4 is a schematic vertical sectional view of the belt based conveying apparatus in the second embodiment of the present invention.

Another embodiment of the present invention is depicted in FIG. 4. As is evident from the drawing, in this embodiment, the driver roller 11 is disposed on the upstream side of the follower roller 14 in terms of the transfer medium conveying direction of the conveyer belt 100, substantially below the transfer medium conveying portion A. In other words, the driver roller is disposed as far away as possible from the fixing apparatus 10. Therefore, the increase in the temperature of the driver roller 11 is minimum. Thus, the fluctuation in the velocity of the conveyer belt 100 is minimum. Therefore, color deviation is minimum. In other words, this embodiment also makes it possible to produce high quality images.

The comparison, in structure and positioning, between a belt based transfer medium conveying apparatus, a registration roller, and their adjacencies, in accordance with the present invention, and those of a conventional type is given in FIG. 5. FIG. 5, (a) represents the present invention, and FIG. 5, (b) represents a conventional type.

In the conventional type, the driver roller 11 is disposed on the transfer medium bearing portion A side, that is, adjacent to the registration roller pair 8, whereas in the type in accordance with the present invention, the follower roller 14 is disposed on the top loop side, that is, the transfer medium conveying side, of the conveyer belt, that is, adjacent to the registration roller pair 8. Since the external diameter of the follower roller 14 may be substantially smaller than that of the driver roller 11, the distance l between the belt based conveying apparatus 7 and the registration roller pair 8 defined in FIG. 5, (a), which represents the present invention, is substantially smaller than the corresponding distance (distance l) defined in FIG. 5, (b) which represents the conventional type.

The difference in the external diameter of the roller disposed adjacent to the registration roller 8 to support the conveyer belt is not the only factor which made this arrangement possible.

More specifically, referring to FIG. 5, the registration roller 8 and driver roller 11 both require a driving mechanism, which generally must be disposed in their adjacencies, for example, on their front or back sides as seen from the direction perpendicular to FIG. 5. The spaces which the driving mechanisms for the driving roller 11 and registration roller pair 8 require are as large as the circular areas designated by referential characters 11*a* and 8*a* in the drawing, and the two rollers must be arranged so that the areas 11*a* and 8*a* do not mutually overlap. Therefore, this embodiment which makes it possible to dispose the registration roller pair 8 and driver roller 11 reasonably apart from each other without changing the internal space of the apparatus main assembly is more advantageous for the size reduction of the apparatus main assembly.

Figure 6:
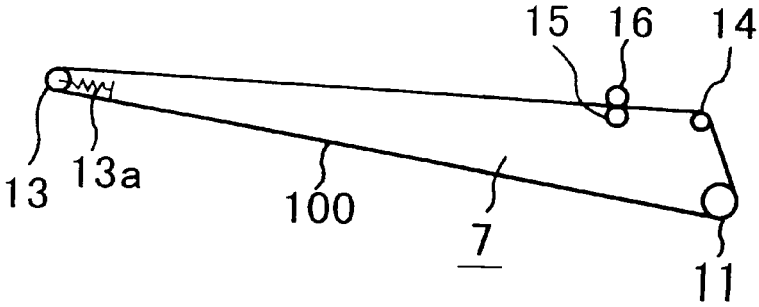
FIG. 6 a schematic vertical sectional view of the belt based conveying apparatus in the modification of the second embodiment of the present invention.
Figure 7:
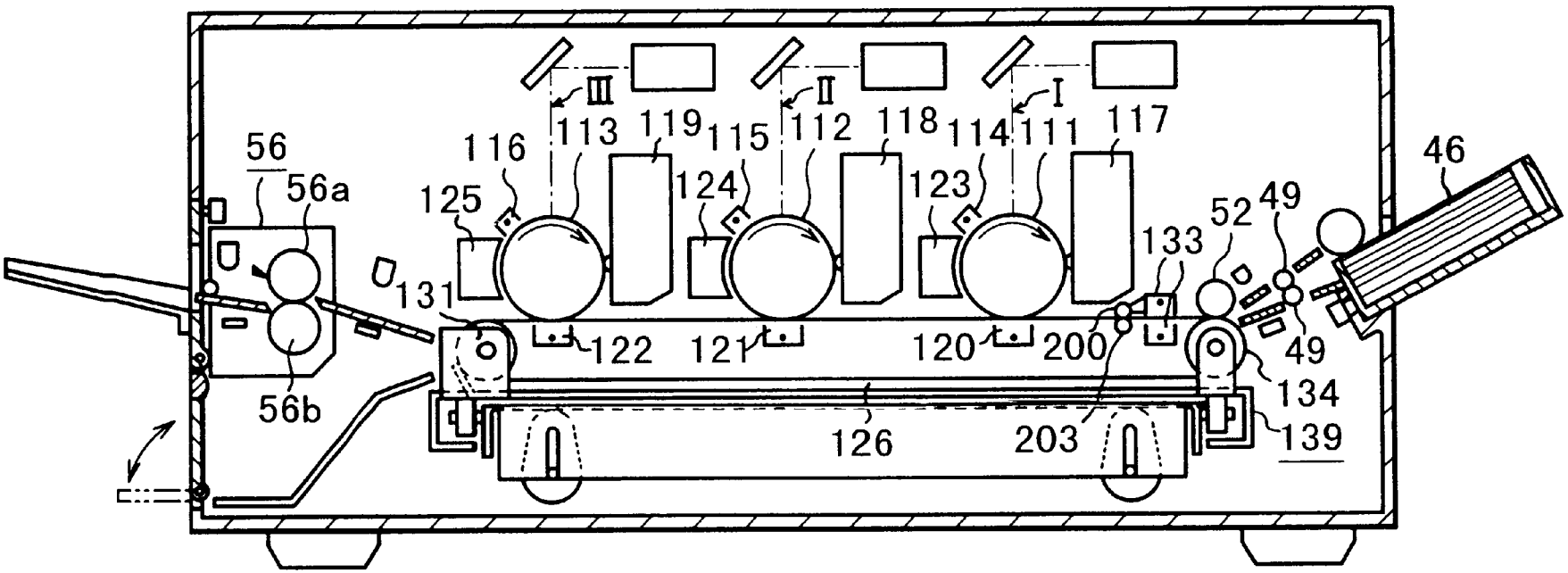
FIG. 7 PRIOR ART
FIG. 7 is a schematic vertical sectional view of a conventional image forming apparatus as seen from the front side of the apparatus.

Even though four rollers are employed in this embodiment to suspend the conveyer belt, the number of rollers may be three as depicted in FIG. 6, which is self-explanatory.

While the invention has been described with reference to the structures disclosed herein, it is not confined to the details set forth, and this application is intended to cover such modifications or change as may come within the purposes of the improvements or the scope of the following claims. For example, in the preceding embodiments, the present invention was described with reference to a photosensitive drum in the form of a drum, but the photosensitive drum may be in the form of a belt, which is needless to say. Further, the present invention is also applicable to an image forming apparatus in which a plurality of image forming station are vertically aligned, and a transfer medium is vertically conveyed (for example, upward) by a conveyer belt (100).

What is claimed is:

1. An image forming apparatus comprising:

a transfer material carrying belt for carrying a transfer material;

supporting means for supporting said transfer material carrying belt at a side opposite from a side carrying the transfer material; and image forming means for forming an image on the transfer material carried on said transfer material carrying belt;

wherein the transfer material is separated from said transfer material carrying belt at a separating position after formation of the image thereon by said image forming means;

wherein said transfer material carrying belt is movable along an endless path including a first part where said transfer material carrying belt carries the transfer material and a second part where said transfer material carrying belt does not carry the transfer material, and wherein said supporting means includes a single driving roller, contacted to said transfer material carrying belt at the second part, for driving said transfer material carrying belt, and a follower roller, contacted to said transfer material carrying belt at the separating position and having a diameter smaller than that of said driving roller.

2. An apparatus according to claim 1, further comprising feeding means for applying a feeding force to the transfer material at a feeding position to feed the transfer material to said carrying belt, attracting means for attracting the transfer material fed by said feeding means on said transfer material carrying belt at an attracting position, wherein a distance from the feeding position to the attracting position measured along a feeding direction of the transfer material is shorter than a length of an usable minimum size transfer material.

3. An apparatus according to claim 2, wherein said feeding means includes a pair of rollers.

4. An apparatus according to claim 2, wherein said attracting means electrostatically attracts the transfer material on the transfer material carrying belt.

5. An apparatus according to claim 1, wherein said supporting means includes a tension roller for applying tension to said transfer material carrying belt.

6. An apparatus according to claim 1, wherein said supporting means includes an adjusting roller for adjusting a parallelism relative to said driving roller.

7. An apparatus according to claim 1, further comprising discharging means for electrically discharging the transfer material carried on said transfer material carrying belt when the transfer material is separated from said transfer material carrying belt.

8. An apparatus according to claim 7, wherein said follower roller is an electroconductive member.

9. An apparatus according to claim 1, wherein a moving direction of the transfer material provided by said transfer material carrying belt comprises a vertical component.

10. An apparatus according to claim 9, wherein the moving direction of the transfer material provided by the transfer material carrying belt is substantially vertical.

11. An apparatus according to claim 1, further comprising a plurality of image bearing members for bearing images of respective colors, the images of different colors on the image bearing members are sequentially and superposedly transferred onto the transfer material carried on said transfer material carrying belt.

12. An apparatus according to claim 1, wherein said image forming means sequentially superimposedly forms a plurality of color images on the transfer material carried on said transfer material carrying belt.

13. An apparatus according to claim 1, wherein said image forming means includes an image bearing member for bearing an image, and a plurality of color images are transferred from said image bearing member onto the transfer material carried on said transfer material carrying belt.

14. An apparatus according to claim 1, wherein a contact angle of said transfer material carrying belt on said driving roller is not less than 90°.

15. An apparatus according to claim 1, wherein said driving roller is provided with a surface rubber.

16. An apparatus according to claim 1, wherein said image forming means is provided with at least one image bearing member for bearing an image, and the image on said image bearing member is transferred onto the transfer material carried on said transfer material carrying belt.

17. An apparatus according to claim 1, wherein said supporting means includes a roller cooperating with said follower roller to form the first part therebetween.

18. An apparatus according to claim 1, wherein said driving roller is disposed downstream of the separating position with respect to a feeding direction of the transfer material.

19. An apparatus according to claim 15, further comprising fixing means for fixing an image on the transfer material by heating it at a fixing position, wherein a distance from the fixing position to the separating position is shorter than a length of an usable medium size transfer material.

20. An apparatus according to claim 19, wherein the fixing position is disposed closer to said image forming means than the first part.

21. An apparatus according to claim 1, wherein a tension force applied to the first part is longer than a tension force applied to the second part of said transfer material carrying belt when said transfer material carrying belt is rotated.

22. An apparatus according to claim 21, further comprising fixing means for fixing an image on the transfer material by heating it at a fixing position, wherein a distance from the fixing position to the separating position is shorter than a length of an usable medium size transfer material.

23. An apparatus according to claim 22, wherein the fixing position is disposed closer to said image forming means than the first part.

24. An apparatus according to claim 1, wherein said driving roller is disposed downstream of a position where said image forming means is disposed with respect to a carrying direction of the transfer material.

25. An apparatus according to claim 24, further comprising fixing means for fixing an image on the transfer material by heating it at a fixed position, wherein a distance from the fixing position to the separating position is shorter than a length of an usable medium size transfer material.

26. An apparatus according to claim 25, wherein the fixing position is disposed closer to said image forming means than the first part.

27. An image forming apparatus comprising:

a transfer material carrying belt for carrying a transfer material;

supporting means for supporting said transfer material carrying belt at a side opposite from a side carrying the transfer material, said supporting means including a single driving roller for driving said transfer material carrying belt; and image forming means for forming an image on the transfer material carried on said transfer material carrying belt;

wherein the transfer material carrying belt is movable along an endless path including a first part where said transfer material carrying belt carries the transfer material and a second part where said transfer material carrying belt does not carry the transfer material, and wherein said driving roller is contacted to said transfer material carrying belt at the second part, and an angle of contact between said transfer material carrying belt and said driving roller is at least 90 degrees.

28. An apparatus according to claim 27, wherein a tension force applied to the first part is longer than a tension force applied to the second part of said transfer material carrying belt when said transfer material carrying belt is rotated.

29. An apparatus according to claim 28, further comprising fixing means for fixing an image on the transfer material by heating it at a fixed position, wherein a distance from the fixing position to a separating position is shorter than a length of an usable medium size transfer material.

30. An apparatus according to claim 29, wherein the fixing position is disposed closer to said image forming means than the first part.

31. An apparatus according to claim 27, wherein said driving roller is disposed downstream of a position where said image forming means is disposed with respect to a carrying direction of the transfer material.

32. An apparatus according to claim 31, further comprising fixing means for fixing an image on the transfer material by heating it at a fixed position, wherein a distance from the fixing position to a separating position is shorter than a length of an usable medium size transfer material.

33. An apparatus according to claim 32, wherein the fixing position is disposed closer to said image forming means than the first part.

34. An image forming apparatus comprising:

a transfer material carrying belt for carrying a transfer material;

supporting means for supporting said transfer material carrying belt at a side opposite from a side carrying the transfer material; and image forming means for forming an image on the transfer material carried on said transfer material carrying belt;

wherein the transfer material carrying belt is movable along an endless path including a first part where said transfer material carrying belt carries the transfer material and a second part where said transfer material carrying belt does not carry the transfer material;

wherein said supporting mean is contacted to said transfer material carrying belt at the second part, and is provided with a single driving roller for driving said transfer material carrying belt; and wherein a moving direction of the transfer material provided by said transfer material carrying belt comprises a vertical component.

35. An apparatus according to claim 34, wherein the moving direction of the transfer material provided by the transfer material carrying belt is substantially vertical.

36. An apparatus according to claim 35, wherein the moving direction of the transfer material by said transfer material carrying belt is substantially vertically upward.

* * * * *

UNITED STATES PATENT AND TRADEMARK OFFICE

CERTIFICATE OF CORRECTION

PATENT NO. : 6,236,828 B1
DATED : May 22, 2001
INVENTOR(S) : Katsumi Munenaka et al.

It is certified that error appears in the above-identified patent and that said Letters Patent is hereby corrected as shown below:

Column 1,
Line 12, "stations," should read -- station, --.
Line 52, "57b" should read -- 56b --.

Figure 5A:
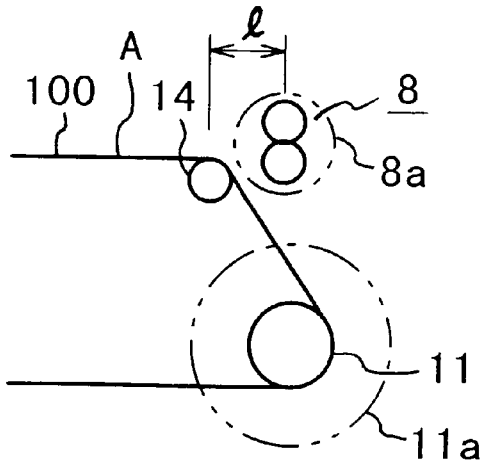
FIG. 5 is a schematic vertical sectional drawing for comparatively depicting a belt based conveying apparatus in the second embodiment of the present invention and a conventional belt based conveying apparatus, (a) and (b) depicting the former and the latter, respectively.
Figure 5B:
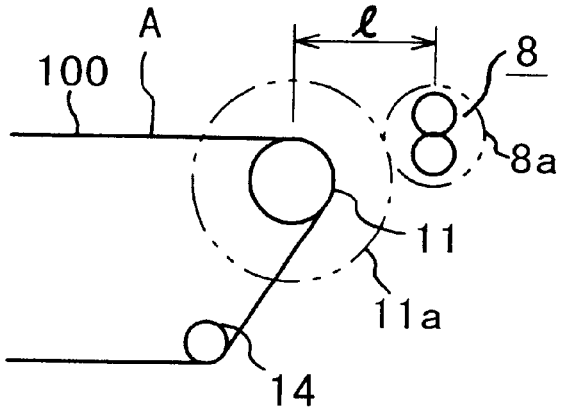
FIG. 5(b) PRIOR ART

Column 5,
Line 10, "FIG. 5." should read -- FIGS. 5(a) and 5(b) are --.
Line 39, "a" should read -- and a --.
Line 52, "(5a-5b)" should read -- (5a-5d) --.

Column 6,
Line 26, "prepared" should read -- prepare --.

Column 10,
Line 15, "FIG. 5." should read -- FIGS. 5(a) and 5(b). --.
Line 34, "FIG. 5," should read -- FIGS. 5(a) and 5(b), --.
Line 38, "FIG. 5." should read -- FIGS. 5(a) and 5(b). --.
Line 65, "station" should read -- stations --.

Column 11,
Line 63, "are" should read -- being --.

Column 12,
Line 24, "claim 15," should read -- claim 18, --.
Line 33, "longer" should read -- greater --.

Column 13,
Line 11, "longer" should read -- greater --.

Signed and Sealed this

Fifth Day of March, 2002

*Attest:*

*Attesting Officer*

JAMES E. ROGAN
*Director of the United States Patent and Trademark Office*